United States Patent [19]

Laeuppi et al.

[11] Patent Number: 4,799,820

[45] Date of Patent: Jan. 24, 1989

[54] ROAD-BUILDING MACHINE

[75] Inventors: Heinrich Laeuppi, Graenichen; Bruno Fedrizzi, Winkel, both of Switzerland

[73] Assignee: Erhard Thoma, Gartringen, Fed. Rep. of Germany

[21] Appl. No.: 34,798

[22] Filed: Apr. 3, 1987

[30] Foreign Application Priority Data

Apr. 4, 1986 [CH] Switzerland ..... 1335/86

[51] Int. Cl.[4] ..... E01C 23/04

[52] U.S. Cl. ..... 404/100; 404/88

[58] Field of Search ..... 404/100, 88, 87, 74, 404/84, 105

[56] References Cited

U.S. PATENT DOCUMENTS

| | | | |
|---|---|---|---|
| 2,389,773 | 11/1945 | Golden | 404/88 |
| 3,443,495 | 5/1969 | Heltzel | 404/100 |
| 3,477,351 | 11/1969 | Funk et al. | 404/100 X |
| 3,853,444 | 12/1974 | Jones | 404/100 X |
| 4,168,135 | 9/1979 | Johansson et al. | 404/100 X |
| 4,433,936 | 2/1984 | Moser | 404/100 X |
| 4,493,584 | 1/1985 | Guntert | 404/100 X |

FOREIGN PATENT DOCUMENTS

| | | | |
|---|---|---|---|
| 154761 | 9/1985 | European Pat. Off. | 404/100 |

*Primary Examiner*—Jerome W. Massie, IV
*Assistant Examiner*—Matthew Smith
*Attorney, Agent, or Firm*—Wolf, Greenfield & Sacks

[57] ABSTRACT

Apparatus for inserting longitudinal studs in a concrete road covering. By means of a longitudinally running sled and forks, an exact parallel orientation of the longitudinal studs is achieved, as well as their arrangement at a predetermined height. Through the automatic loading of a holder for the longitudinal studs and the synchronization of the device with the motion of the device for inserting cross-studs, a minimum distance between the longitudinal ends and the cross-joints is maintained.

7 Claims, 5 Drawing Sheets

ROAD-BUILDING MACHINE

Figure 1:
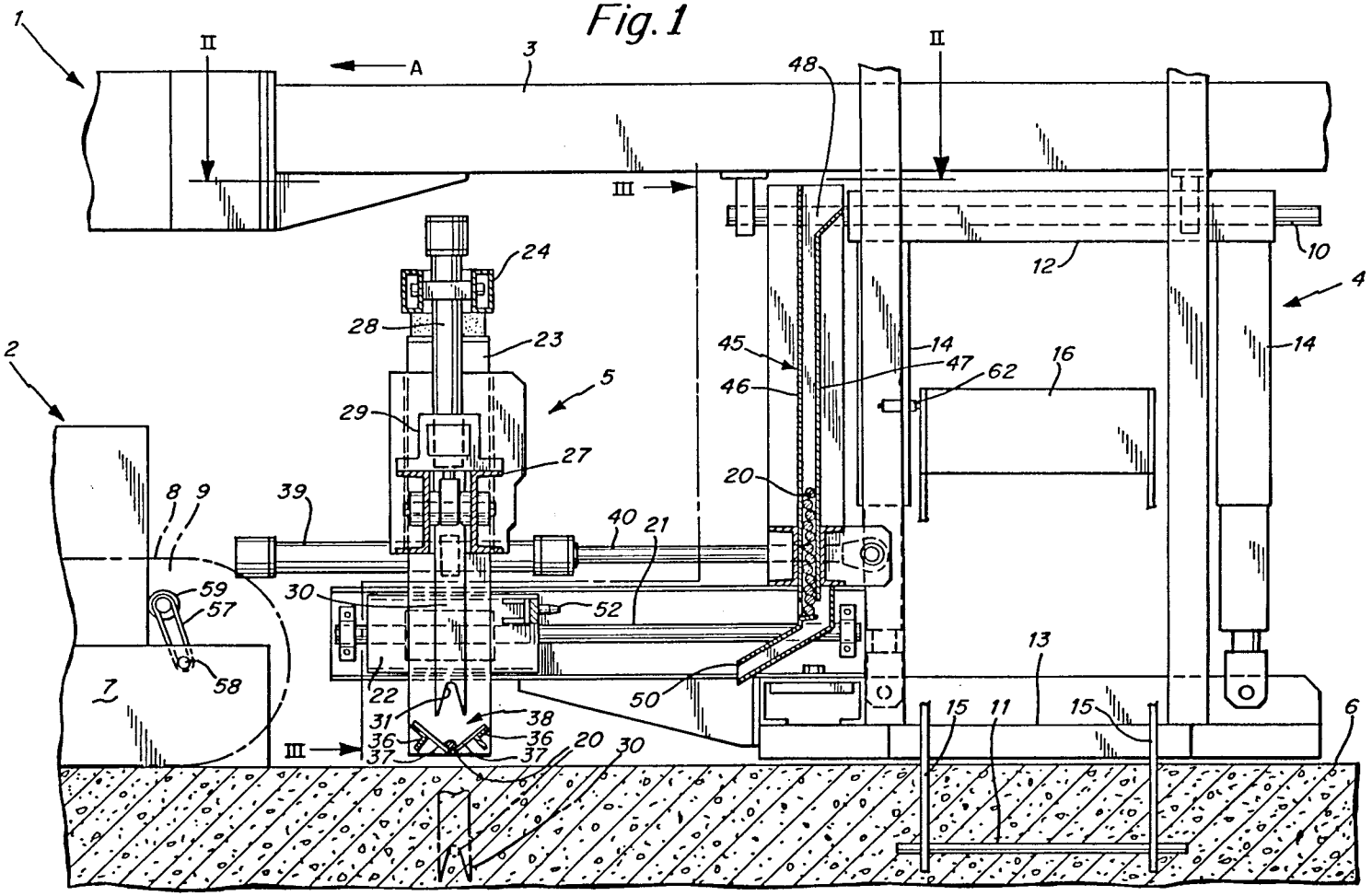

Road coverings of concrete are efficiently made with slide molding finishers. In order for the road covering to be able to absorb thermal expansions, cross joints are made at regular intervals of approximately 5 meters. For simplicity, so-called false joints are often made by stamping cross-grooves into the surface. When the tensile strength is exceeded in concrete, cracks form along these grooves which will compensate in future for thermal expansions of the plates divided up by them. To prevent the plates from displacing each other and also to transfer the force, the separate plates are connected with each other by cross-studs. These cross-studs are usually 50 cm long and are arranged at mutual intervals of approximately 50 cm in the longitudinal direction of the roadway. To install such cross-studs in cross-joints, it is suggested in EP-A No. 154'761 that a plate with slits, held floating just above the roadway, be situated on a sled. For each slit, the plate has one holder each for one cross-stud. On the plate, a vibration beam with pairs of forks, directed vertically downwards, with slit-shaped recesses, is situated in such a fashion that it is vertically movable. The pairs of forks press the cross-studs out of the holders and vibrate them through the slits into the road covering. This arrangement has proven to be very successful.

Wide roadways are often divided up by at least one longitudinal joint. In order to insert longitudinal studs in this longitudinal joint as well, stud rods used to be manually put into the not-yet-thickened concrete in the position of these longitudinal joints in front of the slide molding finisher. This produced very unsatisfactory results, because the orientation and the height of these longitudinal studs varied widely, and furthermore, they collided partially with the cross-studs of the cross-joints. The longitudinal studs should be aligned exactly parallel, so that the longitudinal joint can dilate. Furthermore, a minimum distance from the cross-joints should be maintained. These two conditions could not be met with traditional methods of inserting the longitudinal studs, which frequently caused breaks in the plates in the places where the longitudinal studs were improperly aligned or were too close to the plate edges.

The goal of the invention was to eliminate this disadvantage. This goal was achieved through the characteristic features of claim 1.

By means of the longitudinally running sled and the forks, an exact parallel orientation of the longitudinal studs is achieved, as well as their arrangement at a predetermined height. Through the automatic loading of the holder and the synchronization of the device with the motion of the device for inserting the cross-studs, a minium distance between the longitudinal studs and the cross-joints is maintained.

SUMMARY OF THE INVENTION

The machine (1) has a sliding molding finisher (2) with supports (3) that protrude backwards. One these is a device (4), longitudinally movable, for vibrating in cross-studs (11) into the freshly laid road covering (6) of concrete. Along a guide (21) that is connected with device (4) is a movable device (5) for inserting longitudinal studs (20). This includes a holder (38) for a longitudinal stud (20), a vertically movable vibration beam (27) with forks (30) for pressing the longitudinal stud (20) out of the holder (38) and for vibrating it into the road covering (6). By means of a loading organ (45,52) with a magazine 945), the holder (38) is loaded with a new longitudinal stud (20) during the cycle. The timing of the device (5) is synchronized with that of device (4). In this way, the longitudinal studs (20) are aligned exactly parallel to each other, and a predetermined minimum distance is maintained between the longitudinal studs (20) and the planned cross-joints of the road covering (6).

In the following, a design example of the invention is elucidated with the help of the drawing. The figures show the following:

FIG. 1 A side view of part of the road-building machine

Figure 2:
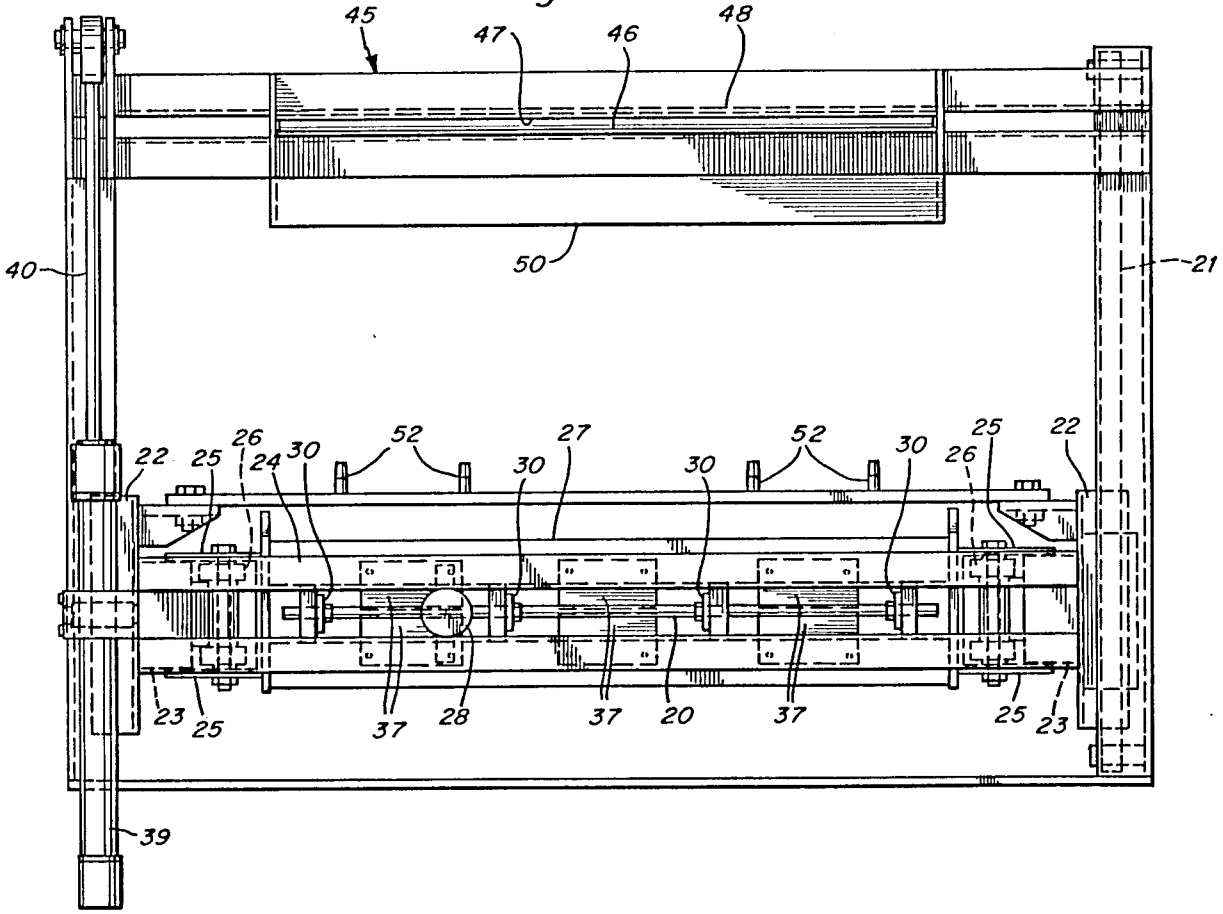

FIG. 2 A view from above onto the device for inserting longitudinal studs in the direction of the Arrow II in FIG. 1

Figure 3:
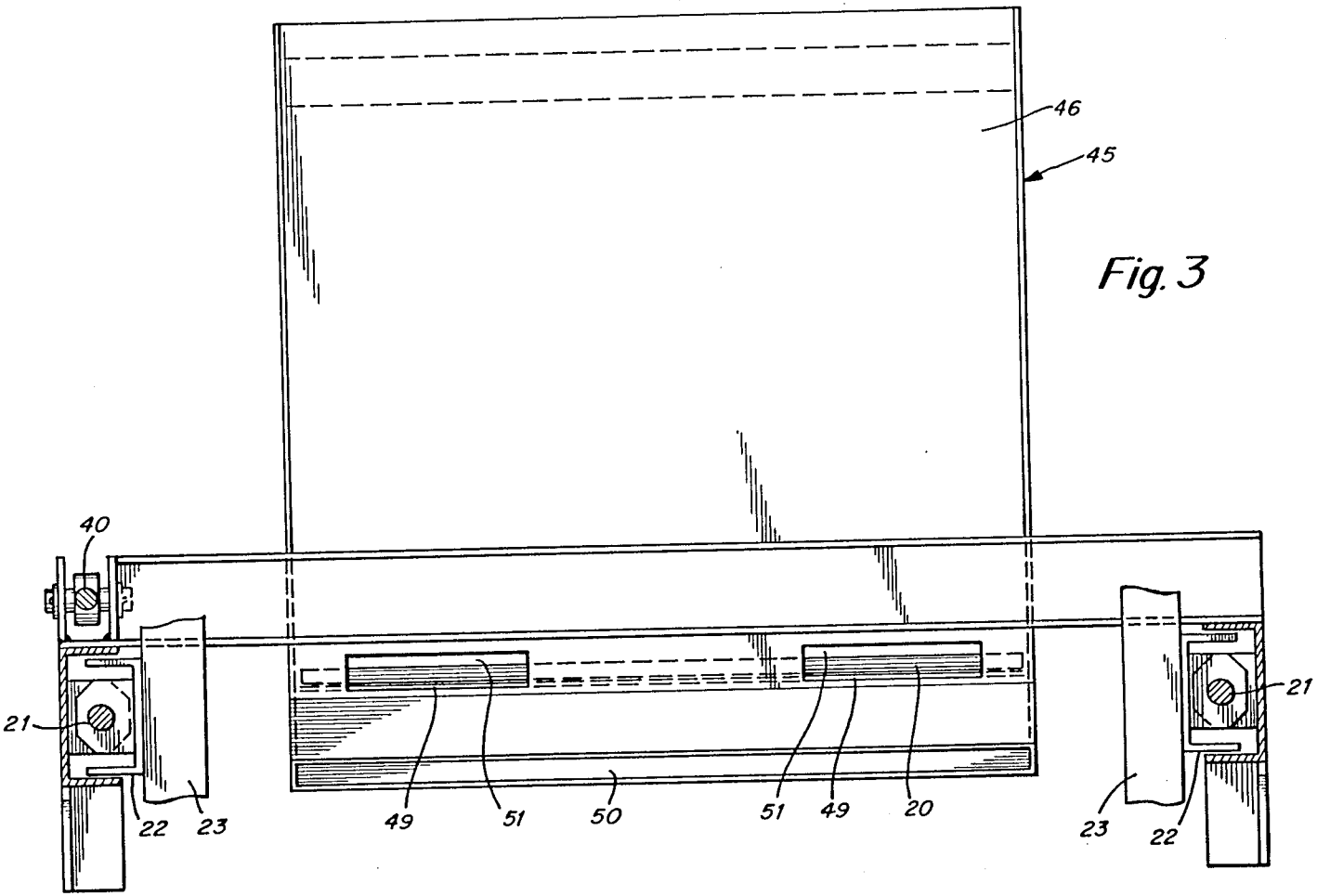

FIG. 3 A view in the direction of Arrow III in FIG. 1

Figure 4:
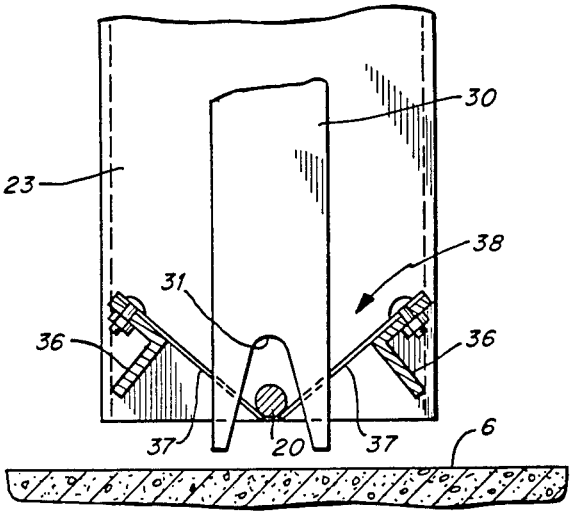
Figure 5:
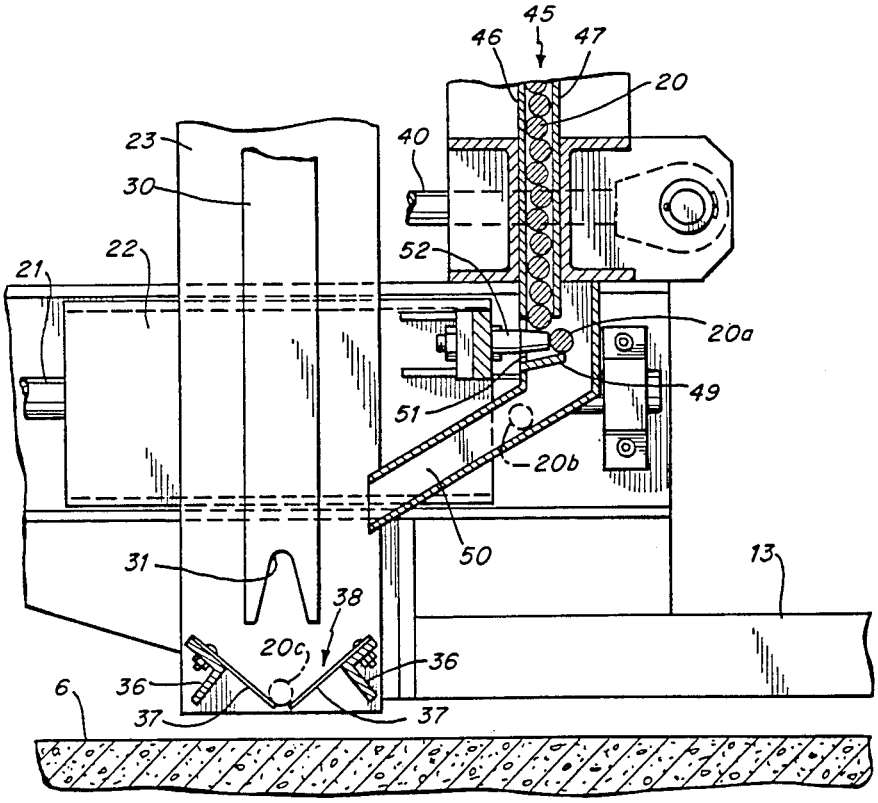
Figure 6:
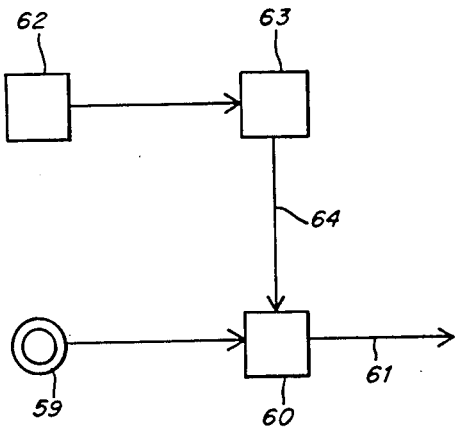

FIG. 4 An enlarged representation of a detail of FIG. 1 at the beginning of a cycle FIG. 5 An enlarged representation of a detail of FIG. 1 in the rear limit position of the sled FIG. 6 A schematic representation of the synchronization device The road building machine 1 in the diagram includes a sliding molding finisher 2, of which only the back end is represented in FIG. 1. At the front of the sliding molding machine 2 is a distribution screw and vibrators (not shown) for distributing and vibrating the concrete, as is known, for example in EP-A No. 154'761, which was already mentioned. The sliding molding finisher has a pressure plate 7 which functions as sliding shell and which thickens the concrete and is moved continuously forward in direction A by means of chains 8 and drive wheels 9. At the back end of the finisher 2 are several horizontal supports 3 in the longitudinal direction of the machine 1.

On each of the supports 3, one guide bar 10 is secured in longitudinal direction of the machine 1. A device 4, which can be built in accordance with EP-A No. 154'761 and is used to insert the cross-studs 11, can be moved along these bars 10. It includes a sled 12 situated on the bars 10; on this sled, by means of columns 14, a plate 13 is held floating just above the road covering 6. On the plate 13 is a vibration beam 16, vertically movable, with forks 15 for vibrating in the cross-studs 11. While the cross-studs 11 are being vibrated in, the device 4 is stationary and therefore moves rearwards relative to support 3 and to finisher 2.

On plate 13 is a device 5 for vibrating in the longitudinal studs 20. It includes two guide bars 21, which are rigidly connected with plate 13 and are aligned in longitudinal direction of the machine 1; on these guide bars, sled 22 is movable. Secured rigidly to sled 22 is a frame consisting of two columns 23 and a yoke 24. On columns 23, a vibration beam 27 is vertically movable by means of metal sheets 25 and rollers 26. The vibration beam is connected with yoke 24 by means of a hydraulic cylinder 28. Secured on the vibration beam 27 is a vibrator 29, which makes the vibration beam vibrate in vertical longitudinal planes during operation. These vibrations are transferred to four forks 30, which are rigidly secured to vibration beam 27 and protrude downward. The forks 30 have a slit-shaped recess 31 on their underside.

On their lower ends, the two columns 23 are connected with each other with two angle sections 36. The angle sections 36 support three pairs of spring plates 37 that are slanted downward. The bottom edges of the spring plates 37 of a pair are arranged symmetrically to the middle plane of the recesses 31, and are at a distance from each other that is less than the diameter of the longitudinal stud 20. The spring plates 37 thus form a holder 38 for the longitudinal stud 20. The distance from the bottom edge of the spring plates 37 to the road covering 6 is somewhat smaller than the length of the recesses 31 (FIG. 4).

The sled 22 is connected with the plate 13 via a hydraulic cylinder 39 which is aligned parallel to the bars 21 and has a piston rod 40. On the plate 13 is a magazine 45 for longitudinal studs 20. The magazine 45 consists of two vertical plates 46 and 47, the distance between which is slightly greater than the diameter of the longitudinal stud. The rear plate 47 is bent at the top and forms a filling funnel 48 for the longitudinal studs 20. On the bottom of front plate 46, a metal sheet 49, slanted slightly backwards and upwards, is welded on. The back plate 47 ends at a distance of slightly more than the diameter of the longitudinal stud above the metal sheet 49. Below the metal sheet 49 is a channel 50 which is slanted forward and downward. In the front plate 46, immediately above the metal sheet 49 are two slits 51, into which, in the back end position of the sled shown in FIG. 5, protrude four bolts 52, which are rigidly connected with sled 22.

The machine operates as follows: In the base position shown in FIG. 1, the sled 22 and the device 4 are both in forward stroke. There is a longitudinal stud 20 in holder 38. The vibration beam 27 is in the upper end position. At the place where a longitudinal stud 20 is to be placed, the cylinder 39 is brought into floating position, i.e., its control valve connects both sides of the piston with the recoil, so that sled 22 can move freely along rods 21. The vibration beam 27 is lowered by means of cylinder 28 into the position shown in FIG. 4. Thus the recesses 31 of the forks 30 catch the longitudinal stud 20. As the vibration beam 27 sinks further, the lower end of the forks 30 touches the road covering 6 first. With further sinking, the longitudinal stud 20 is pressed downwards out of the holder 38. Because the forks 30 are already in engaged with the road covering 6, the longitudinal stud 20 cannot roll away, even if road covering 6 is slanted. Now the vibrator 29 is turned on. Under the influence of the vibrating forks 30, the concrete liquefies around the longitudinal stud 20 which sinks into the road covering 6. At the same time, the sled 22 remains stationary relative to road covering 6; since the finisher 2 continues to move in direction A, the sled therefore moves backwards along rod 21 relative to finisher 2, to support 3 and to device 4. As soon as the lower limit position of cylinder 28 has been reached (signaled by a limit switch not shown), which is depicted in FIG. 1 in thin lines with regard to the longitudinal stud 20 and the forks 30, the vibrator 29 is turned off, the control valve of the cylinder 28 is reversed, and the vibration beam 27 is raised to the upper limit position by means of the cylinder 28.

Now the sled 22 is moved by means of the cylinder 39 into the rear limit position (FIG. 5), where the bolts 52 push the next longitudinal stud 20*a* through the slits 51 over the rear edge of metal sheet 49. The longitudinal stud rolls along the channel 50 (shown in position 20*b*) into the holder 38, thus loading it for the next cycle (position 20*c*). Finally, the sled 22 is pushed forward by means of the cylinder 39 into the base position shown in FIG. 1, where the device 5 is ready for the next cycle. The described cycle of device 5 proceeds automatically and is controlled by limit switches that are not shown.

The cycle of the device 4 for inserting the cross-studs 11 similar: After a manual start of the cycle, for example, the forks 15 press the cross-studs 11 out of holders that are not shown and vibrate them into the road covering 6, while device 4 is stationary and slides backwards on the guide bars 10 relative to support 3 and to finisher 2. After reaching the end position of the forks 15 shown in FIG. 1, the vibrators are turned off, the forks 15 are raised, and the device 4 is brought into the forward end position shown in FIG. 1 by means of a hydraulic cylinder that is not shown.

In order to prevent longitudinal studs 20 from coming to lie too close to cross-joints or from colliding with the cross-studs 11, the cycle of the device 5 is synchronized with that of the device 4. From the finisher 2 a pulse is generated after a certain distance has been covered, e.g., 10 cm. For that purpose, a pulse transmitter 59 is provided, for example, which is connected with the drive shaft 58 of the drive wheel 9 via a chain 57. The pulses of the transmitter 59 are counted in a counter 60. At pre-selected counter states, one starting pulse 61 is transmitted for a new cycle of device 5. The longitudinal studs 20 are thus installed in the road covering 6 at predetermined distances from each other. At the beginning of the cycle of the device 4, when the vibration beam 16 is lowered, a limit switch 62 is activated. In a pulse converter 63, its signal is made into a zero-position pulse 64, which sets the counter 60 back to zero. The timing of device 5 is thus always based on the last preset position for a cross-joint. In this way, despite slightly varying distances between the cross-joints, it can be ensured that the longitudinal studs 20 never lie too close to the cross-joints or collide with the cross-studs 11.

We claim:

1. Road-building machine (1) having a support (3) and a device (4) that is longitudinally movable along the support (3) for inserting cross studs (11) that are oriented parallel to the direction of motion of the machine (1) in positions for cross joints in a freshly-laid road covering (6) of concrete, characterized in that the machine (1) has, additionally, a device (5) carried by the machine for inserting longitudinal studs (20) that are oriented perpendicular to the direction of motion, in the position for longitudinal joints in the road covering (6), including means for synchronizing the cycle of device (5) with that of device (4) comprising first starting means for starting a cycle of the device (5) each time the machine (1) has traveled a predetermined distance, the cycles of device (5) continuing until a cross joint is reached, and second starting means for starting a cycle of device (4) when a cross joint is reached which second means interrupts the operation of device (5) and also generates a reference signal for the subsequent cycles of the device (5) so as to ensure placement of the longitudinal studs at predetermined spaced intervals from each other and the cross studs.

2. Machine according to claim 1, characterized in that the first starting means comprises a pulse transmitter (59) that is connected with a counter (60) and the starting pulse for the cycle of the device (5) is derived from predetermined values in the counter, and the counter is set to zero by the reference signal during the cycle of the device (4).

3. Machine according to claim 2, characterized in that the device (4) includes a vibration beam (16) for inserting the cross studs into the freshly-laid road covering, and the second starting means is responsive to activation of vibration beam (16) for causing the counter (60) to be set to zero.

4. Machine according to claim 1, characterized in that the device (5) includes a horizontal guide (21) mounted on machine (1) in a direction parallel to the direction of motion of the machine (1), a sled (22) that runs along the guide (21), a holder (38) supported on the guide (21) and situated above the road covering (6) for holding a longitudinal stud (20), a vibration beam (27), vertically movable on the sled (22) by means of a first hoisting element (28), which vibration beam has a vibrator (29) and at least one fork (30) directed downward, with a slit-shaped recess (31) on the lower end for pushing the longitudinal stud (20) out of the holder (38) and vibrating it into the road covering 96), a second hoisting element (39) for moving the sled (22) along the guide (21), and an automatic loading organ (45, 49, 51, 52) for automatically loading the holder (38) with longitudinal studs (20).

5. Machine according to claim 4, characterized in that the automatic loading organ includes a magazine (45) having a guide channel (46, 47) for longitudinal studs (20) that are layered over each other, and a ram (52) on the sled (22) for pushing out the lowest longitudinal stud (20) in the magazine (45).

6. Machine according to claim 4, characterized in that the holder (38) is secured to the sled (22) and the lowest edge of the holder (38) is at a distance from the road covering (6) that corresponds approximately to the depth of the slit-shaped recess (31) of the fork (30).

7. Machine according to claim 1, characterized in that the machine (1) includes a sliding molding finisher (2) and the device (5) for inserting the longitudinal studs (20) is situated between the sliding molding finisher (2) and the device (4) for inserting the cross studs (11).

* * * * *

UNITED STATES PATENT AND TRADEMARK OFFICE

CERTIFICATE OF CORRECTION

PATENT NO. : 4,799,820

DATED : January 24, 1989

INVENTOR(S) : Heinrich Laeuppi et al.

It is certified that error appears in the above-identified patent and that said Letters Patent is hereby corrected as shown below:

Column 2, line 2, "945)" should read -- (45) --.

Column 5, line 17, "96)" should read -- (6) --.

Column 6, line 10, "lowest" should read -- lower --.

Signed and Sealed this

Twenty-eighth Day of March, 1989

*Attest:*

DONALD J. QUIGG

*Attesting Officer*

*Commissioner of Patents and Trademarks*